US005964521A

United States Patent [19]

Caya

[11] Patent Number: 5,964,521

[45] Date of Patent: Oct. 12, 1999

[54] HALOGEN TORCHIERE LAMP DIFFUSER APPARATUS

[75] Inventor: Dennis Arthur Caya, Wrentham, Mass.

[73] Assignee: Catalina Lighting, Inc., Miami, Fla.

[21] Appl. No.: 08/783,173

[22] Filed: Jan. 14, 1997

[51] Int. Cl.[6] ..... F21V 7/02; F21S 1/12

[52] U.S. Cl. ..... 362/344; 362/294; 362/414

[58] Field of Search ..... 362/344, 410, 362/411, 414, 802, 294

[56] References Cited

U.S. PATENT DOCUMENTS

| | | | |
|---|---|---|---|
| Re. 8,993 | 12/1879 | Boesch | 362/346 |
| D. 332,840 | 1/1993 | Cohon | D26/93 |
| D. 368,548 | 4/1996 | Lee | D26/106 |
| 1,371,015 | 3/1921 | Amiguet | 362/300 |
| 3,701,898 | 10/1972 | McNamara, Jr. | 240/103 R |
| 4,293,899 | 10/1981 | Sanner | 362/414 |
| 4,482,943 | 11/1984 | Hogue | 362/363 |
| 4,868,727 | 9/1989 | Ponds et al. | 362/344 |
| 5,221,141 | 6/1993 | Swanson | 362/410 |
| 5,402,328 | 3/1995 | Pardo | 362/414 |
| 5,519,594 | 5/1996 | Wu | 362/223 |
| 5,620,247 | 4/1997 | Swanson | 362/414 |
| 5,720,549 | 2/1998 | Lary | 362/414 X |
| 5,791,769 | 8/1998 | Yang | 362/414 X |

OTHER PUBLICATIONS

"UL Urges Consumers to Replace 500–Watt Halogen Bulbs with 300–Watt Halogen Bulbs in Torchiere Lamps", Underwriter's Laboratories, Apr. 1996.

"CPSC Issues Warning on Tubular Halogen Bulbs", NEWS from CPSC, U.S. Consumer Products Safety Commission, Jul. 1996.

"Lighting the way for new halogen torchiere lamps", On the MaRK, Underwriter's Laboratories, Sep. 1996.

*Primary Examiner*—Laura Tso

*Attorney, Agent, or Firm*—Cowan, Liebowitz & Latman, P.C.; Morey B. Wildes

[57] ABSTRACT

A halogen torchiere lamp diffuser apparatus has a reflective element situated directly under the halogen bulb within the lampshade. The reflective element has an elongated projection with a trapezoidal or triangular cross section and with a minimal top surface such that light, and thereby heat, is diffused outward towards the edges of the lampshade and not concentrated immediately above the bulb. In addition, the reflective element has a flat section extending outward from the projection and having curved cutouts therein to allow air to pass the bulb and convect heat away from the bulb. The apparatus can be adapted as a "retrofit" apparatus that can be installed to an existing halogen torchiere lamp by a consumer.

34 Claims, 2 Drawing Sheets

HALOGEN TORCHIERE LAMP DIFFUSER APPARATUS

BACKGROUND OF THE INVENTION

This invention relates to the field of halogen torchiere lamps and, more particularly, to safety measures for halogen torchiere lamps having horizontally-installed bulbs.

A typical halogen torchiere lamp has an upward-facing lampshade mounted atop a long, upright stem. Most halogen torchiere lamps for home use have a double-ended, horizontally-mounted bulb set within the lampshade. Typically, as shown in FIG. 1, a horizontal halogen bulb is mounted on a U-shaped bracket. The bracket is, in turn, mounted on the threaded screw brushing of the stem about its central hole. An optional reflector assembly, which can have the shape of a wide, low-profile rectangular or trapezoidal raised section for reflecting light from a bulb upward and out of the lampshade, may be mounted beneath the bulb. The double-ended halogen bulb is installed in the lampholder above the reflector. A half cylindrical glass shield is held in position above the bulb by means of two clips in order to prevent contact by the user with the bulb.

Most halogen torchiere lamps for home use utilize a 300 watt bulb mounted within the lampshade. Naturally, the 300 watt bulb generates intense heat. The upwardly-directed heat is further intensified by the upward reflection of the bulb's heat and luminescence by the top surface of the reflector and by the inside of the lampshade. The half-cylindrical glass bulb cover, while intended to protect the bulb, unfortunately impedes air circulation and thereby contributes to the heat surrounding the bulb. These factors all contribute to a serious problem during indoor use where halogen torchiere lamps are often placed near draperies, curtains or other window treatments. These window treatments or other materials such as clothing, paper or toys, all of which are often made from flammable materials, could cover the upwardly-facing lampshade or could otherwise contact or come close enough to the bulb such that such materials would then be caused to ignite from the intense heat of the bulb and of its immediately surrounding area. Unfortunately, there have been many instances in which this has in fact occurred, causing severe burns, loss of life and extensive property damage.

There have been many attempts to solve this problem by guarding the bulb against contact with flammable materials. Most of such attempts have concentrated on providing some sort of protective covering for the torchiere lampshade, such as by providing a transparent or wire mesh shield over the lampshade. However, these attempts often resulted in unsightly shadows being cast on the ceiling above the torchiere lamp because of the halogen light shining through the shield. In addition, due to the concentrated heat of the halogen bulb, these shields, which are in close proximity to the bulb, often get almost as hot as the bulb itself and, by restricting air circulation about the bulb, contribute to an even higher temperature about the bulb. Furthermore, even if these shields were to be configured in a convex fashion so as to be further away from the bulb, the profile of the lamp is thereby degraded by an unsightly and protrusive dome.

It is desirable, therefore, to avoid conflagrations caused by contact or proximity of fabrics to a halogen torchiere lamp bulb, but without degrading either the appearance of the lamp or the light cast by the lamp.

It is also desirable to guard a halogen torchiere lamp against causing fires through contact with nearby fabrics by deflecting the intense light and heat away from the area immediately above the halogen bulb, thereby lowering the temperature about the bulb.

It is further desirable to provide an apparatus for lowering the temperature about the bulb of a halogen torchiere lamp without decreasing the intensity of the bulb's luminescence.

SUMMARY OF THE INVENTION

In accordance with the invention, a halogen torchiere lamp diffuser apparatus is provided. The apparatus comprises primarily a raised reflective section situated directly under the halogen bulb within the lampshade for dispersing the halogen bulb's downward-cast light outward toward the edges of the lampshade. The reflective section is shaped as an elongated projection with a trapezoidal or triangular cross section. The projection has a minimal top surface such that light, and thereby heat, is diffused outward and not concentrated immediately above the bulb. In addition, the apparatus comprises a flat section extending outward from the raised projection and having curved cutouts therein to allow air to pass the bulb and convect heat away from the bulb. The apparatus further comprises a glass shield spaced at a critical distance above the bulb and the bulb's cylindrical glass cover, thereby allowing heat to be convected away from the bulb yet not casting undesirable shadows on the ceiling above the bulb. This apparatus can be adapted as a "retrofit" apparatus that can be installed to an existing halogen torchiere lamp by a consumer.

Accordingly, it is one object of the invention to provide an improved safety feature for a halogen torchiere lamp.

It is another object of the invention to provide an improved apparatus for guarding a halogen torchiere lamp against fires caused by entry of nearby fabrics into the immediate vicinity of the halogen bulb.

It is still another object of the invention to provide an improved apparatus for avoiding conflagrations caused by contact or proximity of fabrics to a halogen torchiere lamp bulb but without degrading the appearance of the torchiere lamp or casting undesirable shadows above the torchiere lamp.

It is yet another object of the invention to provide an improved safety feature for a halogen torchiere lamp that lowers the temperature about the halogen bulb.

It is a further object of the invention to provide an apparatus for lowering the temperature about the bulb of a halogen torchiere lamp without decreasing the intensity of the bulb's luminescence.

BRIEF DESCRIPTION OF THE DRAWINGS

The above and other objects and advantages of the invention will be apparent upon consideration of the following detailed description, taken in conjunction with the accompanying drawings, in which the reference characters refer to like parts throughout and in which.

DETAILED DESCRIPTION OF THE INVENTION

Figure 1:
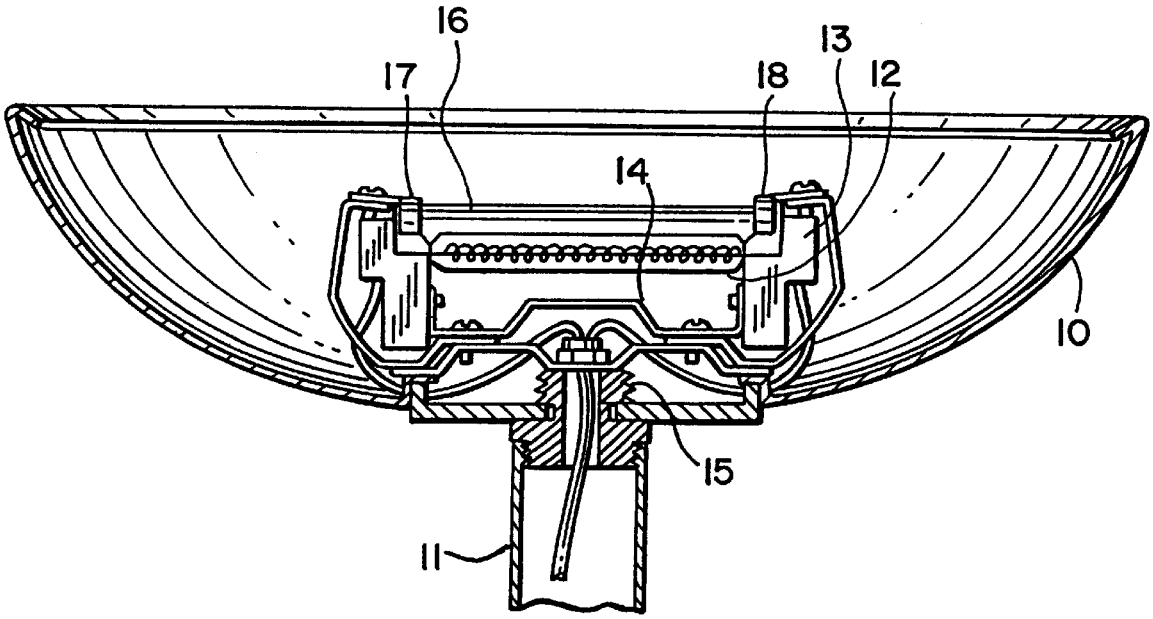
FIG. 1 (PRIOR ART)
FIG. 1 is a perspective partially-cross-sectional view of a prior art halogen torchiere lamp.
Figure 2:
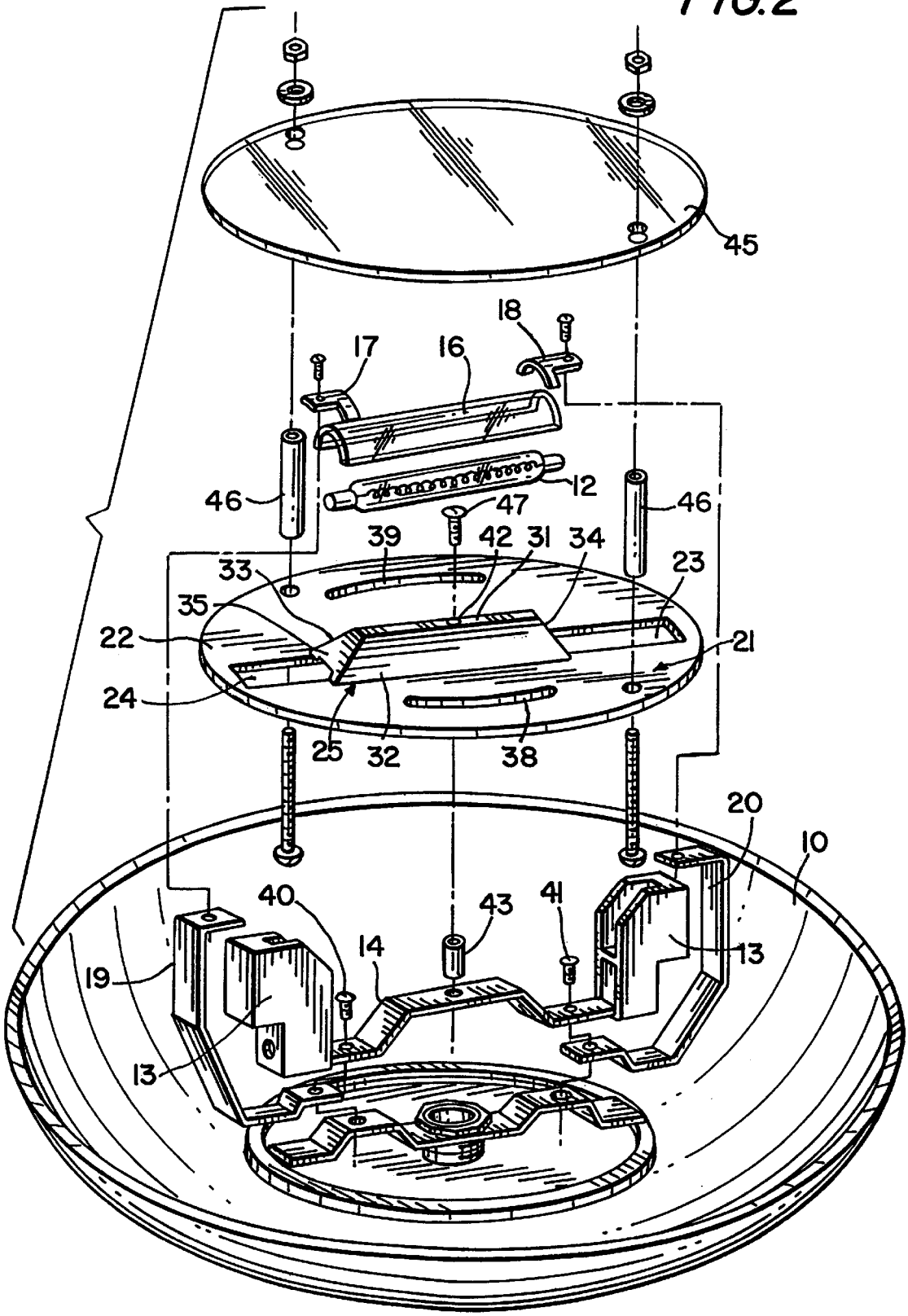
FIG. 2 is an exploded perspective view of a halogen lamp having the apparatus of the present invention.

Referring to FIG. 1, a prior art halogen torchiere lamp typically has a double-ended, horizontally-mounted bulb 12 set within the lampshade 10. Horizontal halogen bulb 12 is supported within lampshade 10 by a double-ended lampholder 13, having appropriate electrical contacts (not shown) and is mounted on a U-shaped bracket 14. Bracket 14 is installed on the threaded screw brushing 15 of stem 11 about its central hole. An optional reflector assembly (not shown), which can have the shape of a wide, low-profile rectangular or trapezoidal raised section, for reflecting light from bulb 12 upward and out of lampshade 10, may be mounted beneath bulb 12. The double-ended halogen bulb 12 is installed in the lampholder 13 above the reflector assembly. A half cylindrical glass shield 16 is held in position above bulb 12 means of two clips 17,18 that attach to brackets 19,20 in order to prevent contact by the user with bulb 12. Brackets 19,20 are secured to U-shaped bracket 14 by way of screws 40,41 through appropriate holes in brackets 19,20 and bracket 14. The halogen torchiere lamp of the present invention comprises all the elements of the prior art halogen torchiere lamp but further comprises elements, as shown in FIG. 2, that make this apparatus novel.

A first element of the apparatus is a reflective element 21 mounted beneath horizontally-mounted halogen bulb 12. Reflective element 21 has a flat peripheral portion 22 of circular shape and is dimensioned to fit within the upward-facing lampshade 10 of a typical halogen torchiere lamp. For the typical halogen torchiere lamp having a lampshade diameter of 12–14 inches, the preferred diameter of reflective element 21 is between 6–7 inches. Preferably, reflective element 21 is formed of thin gauge aluminum but can be formed of any other material having reflective properties on its top surface. Reflective element 21 has cutouts 23,24 through which the two ends of U-shaped bracket 14 and the attached lampholder 13 project on either end of horizontally-mounted bulb 12 to allow reflective element 21 to be mounted beneath bulb 12. Reflective element 21 serves to reflect upward the light and heat cast downward by bulb 12.

Figure 3:
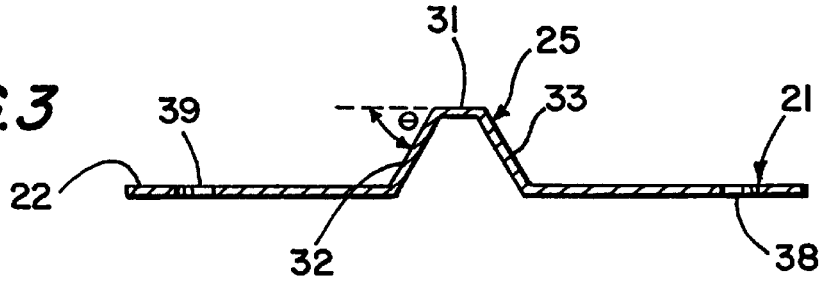
FIG. 3 is a cross-sectional view of a first embodiment of the reflective element of the current invention.

At the approximate center of reflective element 21, a section has been pressed upward through the material of element 21 to form an elongated projection 25 having a trapezoidal cross-section along its middle portion, as shown in FIG. 3. Projection 25 has a very narrow, flat, upward-facing top surface 31 and two sides 32,33 that slope downward and outward. The angle θ at which sides 32,33 slope downward from top surface 31 of projection 25 can be varied according to the desired "spread" of light by the lampshade desired but is preferably approximately 45°. This preferred angle provides a proper balance between dispersion of light and heat laterally away from bulb 12 towards the outer edges of lampshade and reflection of light upwards. The ends 34,35 of elongated projection 25 also slope downward from top surface 31, preferably the same angle as the slope of sides 32,33. Projection 25 differs from the low profile reflector assemblies of the prior art in that projection 25 is raised to directly under bulb 12 and has a minimal top surface 31 in order not to reflect light or heat from bulb 12 upward. In contrast, prior art reflectors have a wide top surface in order to reflect light and heat from the halogen bulb directly upward.

Figure 4:
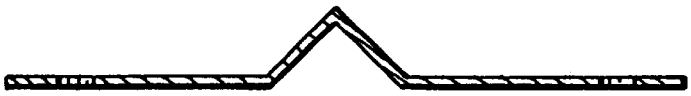
FIG. 4 is a cross-sectional view of a second embodiment of the reflective element of the current invention.

A screw 47 is set downward through a hole 42 formed through flat top surface 31 of projection 25 in order to set reflective element 21 relative to lampshade 10 and bulb 12. Spacer 43 is provided beneath reflective element 21 in order to maintain the protrusion and shape of projection 25. In another embodiment, reflective element 21 may be set relative to lampshade 10 and bulb 12 by virtue of one or more screws set elsewhere on element 21. In this second embodiment, because a region to accomodate screw 47 is not needed, projection 25 could have a triangular, rather than a trapezoidal cross-section, as shown in FIG. 4. Because the function of projection 25 is to reflect light and heat from bulb 12 away from the region immediately above and surrounding bulb 12, even the very narrow top surface 31 of projection 25 effectively provides a horizontal surface for upward reflection of light and heat from bulb 12 and may be counterproductive, especially where top surface 31 is wider than necessary to allow for screw 47.

In a further alternative embodiment (not shown), projection 25 may have a trapezoidal cross-section, similar to that shown in FIG. 3, only at a short portion in the center of the length of projection 25, where it is necessary to provide a surface for the attachment of screw 41. On either side of the short trapezoidal, cross-sectioned portion of projection 25, the cross-section of projection 25 is triangular, similar to that shown in FIG. 4, thereby allowing virtually all downward-cast light and heat from bulb 12 to be reflected outward and not upward back toward bulb 12.

Along the sides 32,33 of projection 25, two sections 38,39 are cut out of the flat peripheral portion of reflective element 21. Cutouts 38,39 may be of any contour or shape but are preferably in a curved shape that conforms to the circular shape of the outside edge of reflective element 21. Cutouts 38,39 allow air to pass from under reflective element 21, through cutouts 38,39 and upward past bulb 12. This air current serves to convect heat upward and away from bulb 12, thereby effectively preventing the temperature about bulb 12 from rising to a hazardous temperature. Although prior art halogen torchiere lamps may have allowed air to convect heat upward away from the halogen bulb 12, providing enlarged cutouts 38,39 through a reflective element 21 situated under bulb 12 allows this convection to occur much more effectively.

In another feature of the invention, a horizontally-oriented tempered glass plate 45 is spaced vertically above bulb 12 and its half-cylindrical glass shield 16. Glass plate 45 provides additional protection against fabrics falling against bulb 12 and shield 16, which both rise to very high temperatures and may cause the fabrics to burn. However, if glass plate 45 is spaced too close to bulb 12 or shield 16, it too will absorb the intense heat from bulb 12 and rise to a temperature that could inflame any nearby fabrics. Therefore, raising glass plate 45 such that it is further spaced from bulb 12 and shield 16 allows air to convect around glass plate 45 and thereby lower both the ambient temperature about bulb 12 and the temperature of glass plate 45. Preferably, glass plate 45 should be spaced at least approximately 2½ inches from reflective element 21. This is accomplished, as shown in FIG. 2, using standoffs or spacers 46 that are secured at their bottoms to reflective element 21 and their tops to glass plate 45.

The elements of the apparatus herein described can be arranged to be installed into an already-existing halogen torchiere lamp and need not be provided as part of the a halogen torchiere lamp for sale. Reflective element 21, screw 47, spacer 43, spacers 46 and glass plate 45 can all be provided to the consumer as a retrofit kit to allow the consumer to install these safety devices into the existing halogen torchiere lamp.

Thus, a halogen torchiere lamp diffuser apparatus is provided. One skilled in the art will appreciate that the present invention can be practiced by other than the described embodiments, which are provided for purposes of illustration and not limitation, and that the present invention is limited only by the claims that follow.

I claim:

1. A diffuser apparatus for a halogen torchiere lamp having an elongated, horizontally-mounted bulb, comprising:

a reflective element having a flat peripheral portion and a raised central portion, said raised portion being elongated and having a substantially trapezoidal cross-sectional shape and said peripheral portion being substantially flat and having at least one cutout therethrough, said reflective element being mounted beneath said horizontally mounted bulb such that said elongated raised portion extends under said bulb in a direction parallel to said bulb, whereby light and heat generated by said bulb are reflected off said raised portion away from said bulb, and whereby said at least one cutout allows convection of heat away from said bulb, in order to prevent concentration of light and heat about said bulb.

2. The diffuser apparatus of claim 1 wherein said elongated raised portion of said reflective element has a top surface and has two side surfaces that are angled with respect to said top surface and with respect to said flat peripheral portion, wherein said top and side surfaces together form a substantially trapezoidal cross-sectional shape.

3. The diffuser apparatus of claim 2 wherein said side surfaces are angled downward with respect to said top surface at an angle of approximately 45 degrees.

4. The diffuser apparatus of claim 2 wherein said top surface is wide enough to accommodate a set screw for attaching said reflective element to said halogen torchiere lamp.

5. The diffuser apparatus of claim 1 wherein said elongated raised portion of said reflective element has a middle region and two end regions each positioned on one end of said middle region, said middle region having a top surface and two side surfaces that are angled with respect to said top surface and with respect to said flat peripheral portion, wherein said top and side surfaces of said middle region together form a substantially trapezoidal cross-sectional shape, said two end regions each having two side surfaces that are angled with respect to each other and with respect to said flat peripheral portion, wherein said side surfaces of said end regions together form a substantially triangular cross-sectional shape.

6. The diffuser apparatus of claim 5 wherein said top surface of said middle region is wide enough to accommodate a set screw for attaching said reflective element to said halogen torchiere lamp.

7. The diffuser apparatus of claim 6 wherein said top surface of said middle region is long enough to accommodate said set screw for attaching said reflective element to said halogen torchiere lamp.

8. The diffuser apparatus of claim 5 wherein said side surfaces of said middle region are angled downward with respect to said top surface at an angle of approximately 45 degrees.

9. The diffuser apparatus of claim 5 wherein said side surfaces of said end regions are angled downward with respect to said flat peripheral portion at an angle of approximately 45 degrees.

10. The diffuser apparatus of claim 1 wherein said halogen torchiere lamp has a lampshade, said diffuser apparatus further comprising means for attaching said reflective element to said inside of said lampshade.

11. The diffuser apparatus of claim 1 further comprising at least two cutouts disposed through said flat peripheral portion of said reflective element, whereby said cutouts allow air to convect heat away from said bulb.

12. The diffuser apparatus of claim 11 further comprising two cutouts disposed through said flat peripheral portion of said reflective element, each-said cutout disposed on an opposite side of said elongated raised portion of said reflective element.

13. A diffuser apparatus for use in a halogen torchiere lamp having an elongated, horizontally-mounted bulb, comprising:

a reflective element having a substantially flat peripheral portion and a raised central portion, said raised portion being elongated and having a substantially triangular cross-sectional shape and said peripheral portion being substantially flat and having at least one cutout therethrough, wherein said reflective element is mounted beneath said horizontally mounted bulb such that said elongated raised portion extends under said bulb in a direction parallel to said bulb, whereby light and heat generated by said bulb are reflected off said raised portion away from said bulb, and whereby said at least one cutout allows convection of heat away from said bulb, in order to prevent concentration of light and heat about said bulb.

14. The diffuser apparatus of claim 13 wherein said elongated raised portion of said reflective element has two side surfaces that are angled with respect to said flat peripheral portion, wherein said side surfaces together form a substantially triangular cross-sectional shape.

15. The diffuser apparatus of claim 14 wherein said side surfaces of said middle region are angled downward with respect to said top surface at an angle of approximately 45 degrees.

16. The diffuser apparatus of claim 13 wherein said halogen torchiere lamp has a lampshade, said diffuser apparatus further comprising means for attaching said reflective element to said inside of said lampshade.

17. A The diffuser apparatus of claim 13 further comprising at least two cutouts disposed through said flat peripheral portion of said reflective element, whereby said cutouts allow air to convect heat away from said bulb.

18. The diffuser apparatus of claim 17 further comprising two cutouts disposed through said flat peripheral portion of said reflective element, each said cutout disposed on an opposite side of said elongated raised portion of said reflective element.

19. The diffuser apparatus of claim 18 wherein said halogen torchiere lamp has a lampshade, said diffuser apparatus further comprising means for attaching said reflective element to said inside of said lampshade.

20. The diffuser apparatus of claim 17 wherein said halogen torchiere lamp has a lampshade, said diffuser apparatus further comprising means for attaching said reflective element to said inside of said lampshade.

21. A diffuser apparatus for use in a halogen torchiere lamp having an elongated, horizontally-mounted bulb, comprising:

a reflective element having a substantially flat peripheral portion and a raised central portion, said raised portion being elongated and having a cross-sectional shape adapted for reflection of light from said bulb away from said bulb, and said peripheral portion being substantially flat and having at least one cutout therethrough, wherein said reflective element is mounted beneath said horizontally mounted bulb such that said elongated raised portion extends under said bulb in a direction parallel to said bulb, whereby light and heat generated by said bulb are reflected off said raised portion away from said bulb, and whereby said at least one cutout allows convection of heat away from said bulb, in order to prevent concentration of light and heat about said bulb.

22. The diffuser apparatus of claim 21 wherein said elongated raised portion of said reflective element has two side surfaces that are angled with respect to said flat peripheral portion, wherein said side surfaces together form a substantially triangular cross-sectional shape.

23. The diffuser apparatus of claim 22 wherein said side surfaces of said middle region are angled downward with respect to said top surface at an angle of approximately 45 degrees.

24. The diffuser apparatus of claim 21 wherein said elongated raised portion of said reflective element has a top surface and has two side surfaces that are angled with respect to said top surface and with respect to said flat peripheral portion, wherein said top and side surfaces together form a substantially trapezoidal cross-sectional shape.

25. The diffuser apparatus of claim 24 wherein said side surfaces are angled downward with respect to said top surface at an angle of approximately 45 degrees.

26. The diffuser apparatus of claim 24 wherein said top surface is wide enough to accommodate a set screw for attaching said reflective element to said halogen torchiere lamp.

27. The diffuser apparatus of claim 21 wherein said elongated raised portion of said reflective element has a middle region and two end regions each positioned on one end of said middle region, said middle region having a top surface and two side surfaces that are angled with respect to said top surface and with respect to said flat peripheral portion, wherein said top and side surfaces of said middle region together form a substantially trapezoidal cross-sectional shape, said two end regions each having two side surfaces that are angled with respect to each other and with respect to said flat peripheral portion, wherein said side surfaces of said end regions together form a substantially triangular cross-sectional shape.

28. The diffuser apparatus of claim 27 wherein said top surface of said middle region is wide enough to accommodate a set screw for attaching said reflective element to said halogen torchiere lamp.

29. The diffuser apparatus of claim 27 wherein said top surface of said middle region is long enough to accommodate said set screw for attaching said reflective element to said halogen torchiere lamp.

30. The diffuser apparatus of claim 27 wherein said side surfaces of said middle region are angled downward with respect to said top surface at an angle of approximately 45 degrees.

31. The diffuser apparatus of claim 27 wherein said side surfaces of said end regions are angled downward with respect to said flat peripheral portion at an angle of approximately 45 degrees.

32. The diffuser apparatus of claim 21 wherein said halogen torchiere lamp has a lampshade, said diffuser apparatus further comprising means for attaching said reflective element to said inside of said lampshade.

33. The diffuser apparatus of claim 21 further comprising at least two cutouts disposed through said flat peripheral portion of said reflective element, whereby said cutouts allow air to convect heat away from said bulb.

34. The diffuser apparatus of claim 33 further comprising two cutouts disposed through said flat peripheral portion of said reflective element, each said cutout disposed on an opposite side of said elongated raised portion of said reflective element.

* * * * *